US005244243A

United States Patent [19]

Grayson et al.

[11] Patent Number: 5,244,243

[45] Date of Patent: Sep. 14, 1993

[54] APPARATUS FOR ATTACHING A LIFTING MECHANISM TO A LOAD

[75] Inventors: Boyd H. Grayson, Lakeland; Richard J. Beak, Tampa, both of Fla.

[73] Assignee: MMI Products, Inc., Houston, Tex.

[21] Appl. No.: 934,428

[22] Filed: Aug. 24, 1992

[51] Int. Cl.[5] ..... B66C 1/66

[52] U.S. Cl. ..... 294/89; 294/82.35

[58] Field of Search ..... 294/89, 82.24, 82.31, 294/82.33, 82.34, 82.35; 24/598.3, 601.6; 52/125.4, 125.5, 698-701, 704, 706

[56] References Cited

U.S. PATENT DOCUMENTS

| | | | |
|---|---|---|---|
| 839,036 | 12/1906 | Roberts | 294/82.31 |
| 1,392,260 | 9/1921 | Schollar | 294/82.24 |
| 2,595,450 | 5/1952 | Coffing | 294/82.33 |
| 3,883,170 | 5/1975 | Fricker et al. | 294/89 X |
| 4,173,367 | 11/1979 | Haeussler | 294/89 X |
| 4,367,892 | 1/1983 | Holt | 294/89 |
| 4,634,164 | 1/1987 | Fricker | 294/82.24 X |

FOREIGN PATENT DOCUMENTS

| | | | |
|---|---|---|---|
| 472841 | 5/1954 | Italy | 294/82.31 |
| 23189 | 1/1991 | Japan | 294/82.35 |
| 1237601 | 6/1986 | U.S.S.R. | 294/82.35 |

*Primary Examiner*—David M. Mitchell
*Assistant Examiner*—Dean J. Kramer
*Attorney, Agent, or Firm*—Pettis & McDonald

[57] ABSTRACT

An apparatus for connecting a lifting mechanism to a load, the apparatus comprising a hollow annular body having a radial slot extending from the periphery of the body inwardly toward a central aperture. An arcuate bolt is operatively movable within the cavity of the body between a closed position wherein the bolt traverses the slot and thereby engages the load and an open position wherein the bolt is clear of the slot and, thus, disengaged from the load. At least one connector link and an actuating link lock the bolt in the closed position until the actuating link is operated on by a release mechanism.

5 Claims, 4 Drawing Sheets

APPARATUS FOR ATTACHING A LIFTING MECHANISM TO A LOAD

BACKGROUND OF THE INVENTION

1. Field of the Invention

The present invention relates to an apparatus for releasably connecting a lifting mechanism to a load. More specifically, the apparatus comprises a hollow annular body with a movable bolt within the cavity. When the bolt is in the closed position, it engages the load. The bolt is locked in the closed position until the bolt is opened by a remote release. The apparatus is especially suitable for lifting operations in connection with tilt-up panels used in the construction industry.

2. Description of the Prior Art

Prefabricated building components, including precast tilt-up panels, are widely used within the construction industry to provide a more efficient and rapid means of construction. To avoid using lifting anchors that protrude from the building components, recessed anchors were developed and have been used successfully. Such recessed anchors and their related lifting devices have been disclosed by Haeussler in U.S. Pat. No. 4,173,367, by Fricker in U.S. Pat. No. 4,173,856, and by Kelly in U.S. Pat. No. 4,580,378. The hoisting shackle with quick release attachment disclosed by Fricker in U.S. Pat. No. 3,883,170 uses a shackle formed as a hollow ring having a slot formed therein. An anchor having a first end attached to a building component has a second end that projects through the slot in the hollow ring. A curved bolt is selectively moved within the hollow ring across the slot to engage the anchor. This device uses a Bowdin cable to move the curved bolt to the open position so that the shackle may be removed from the anchor. U.S. Pat. No. 4,437,642 issued to Holt modified the Fricker shackle by elongating the operating lever. This lever arm engages a second lifting shackle while the load is being lifted, preventing the opening of the ring shackle. When the lifting line goes slack, the lifting shackle moves away from the lever arm permitting the ring shackle to open.

Notwithstanding the existence of such prior art, it remains clear that there is a need for a lifting apparatus that maintains a closed position even when slack has occurred in the lifting line between the lifting mechanism and the load. The present invention is an improvement of the apparatus disclosed by Fricker '170.

SUMMARY OF THE INVENTION

The present invention relates to an apparatus for attaching a lifting means to a load. The current invention comprises a hollow annular body having an annular cavity formed therein and a generally central aperture formed through the body. The maximum circumference of the body defines a peripheral edge about the body. A radial slot extends generally transverse to the cavity from the outer peripheral edge to a point at least substantially across the cavity. A segment of the peripheral edge is open. This open segment lies generally opposed to that portion of the peripheral edge from which the radial slot extends.

An arcuate bolt is received within the cavity of the body and is operatively movable within the cavity, from a closed position where the first end of the bolt extends across the radial slot, to an open position where the bolt is clear of the radial slot. The first end of at least one connector link is pivotally attached to the second end of the bolt. The first end of an actuating link is pivotally attached to the second end of the connector link and the second end of the actuating link is pivotally connected to the annular body. A section of the actuating link extends outwardly through the opening in the peripheral edge.

A release means is attached to the outwardly extending section of the actuating link so that the first end of the actuating link may be pivoted about its second end, through the open segment, and outwardly from the body. This movement of the actuating link causes the bolt to move from the closed position to the open position so that the apparatus may be removed from the load to be lifted.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
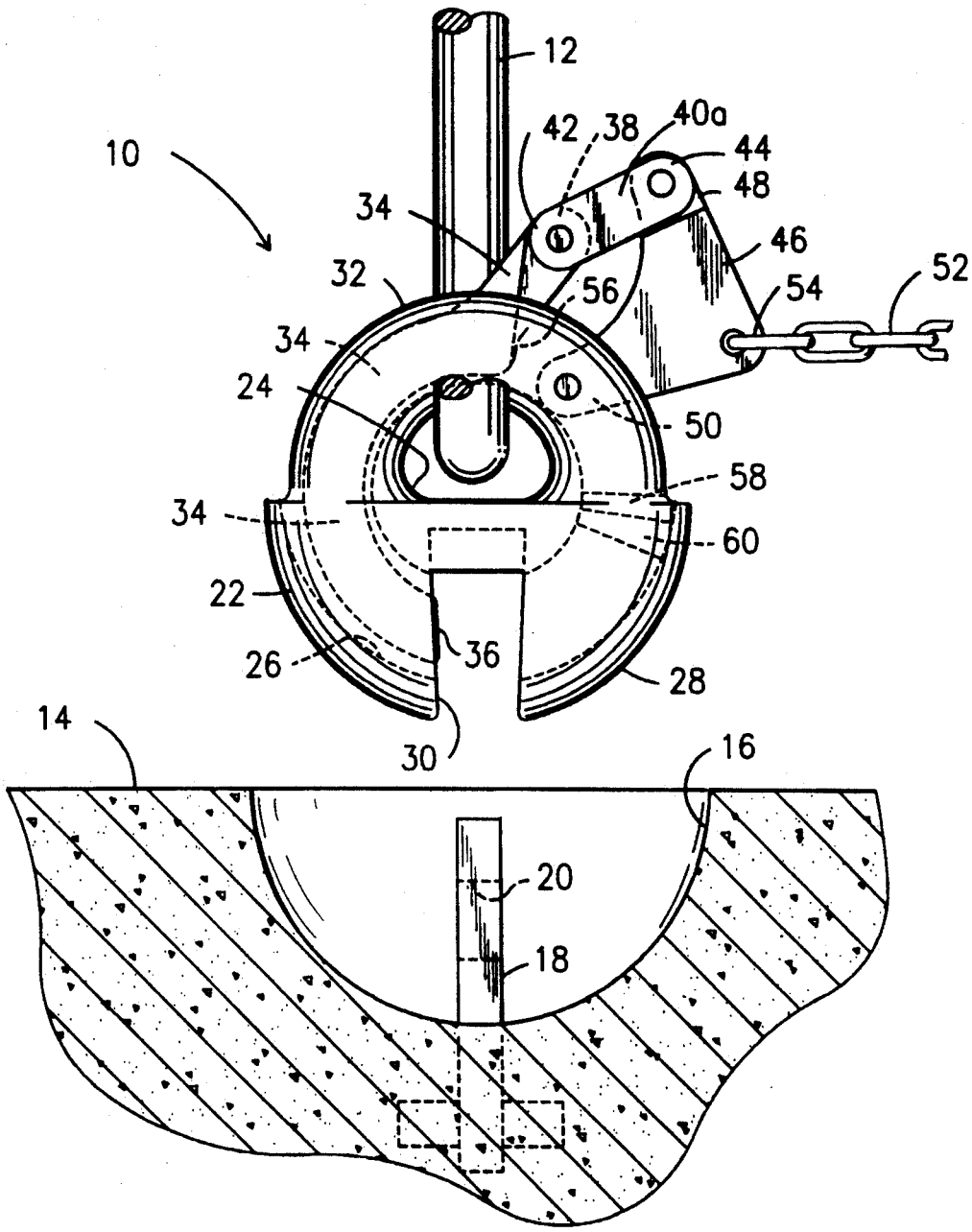
FIG. 1 is a front elevation of a preferred embodiment of this invention attached to a typical shackle, that has been broken away, and a front elevation of a typical anchor system to which the apparatus may be attached.
Figure 5:
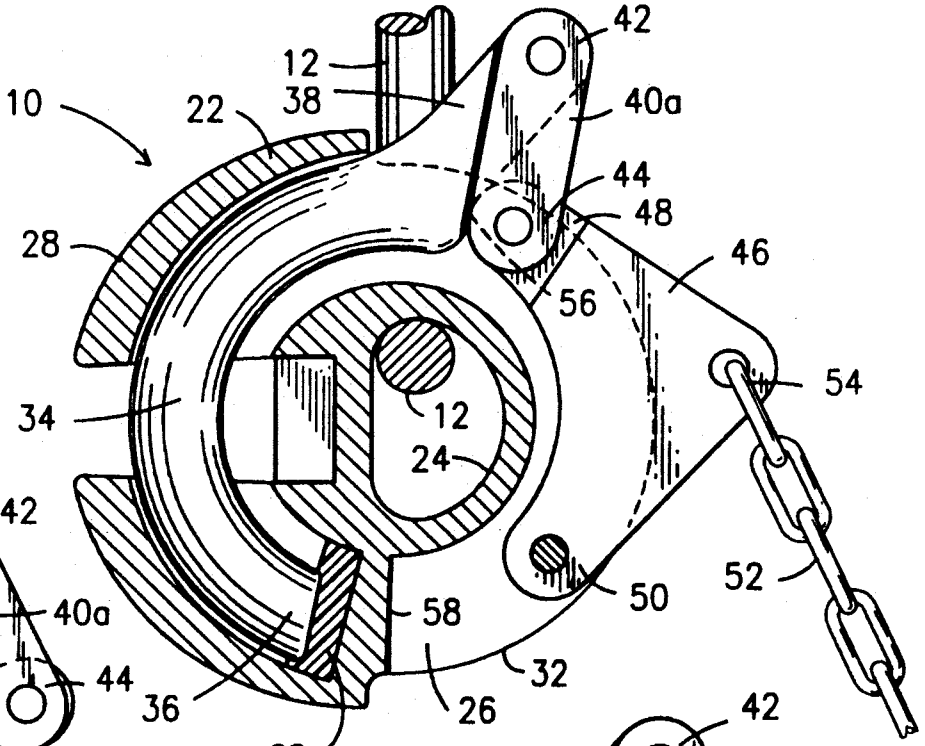
FIG. 5 shows the apparatus of FIG. 2 partially in section to illustrate the interior detail.
Figure 6:
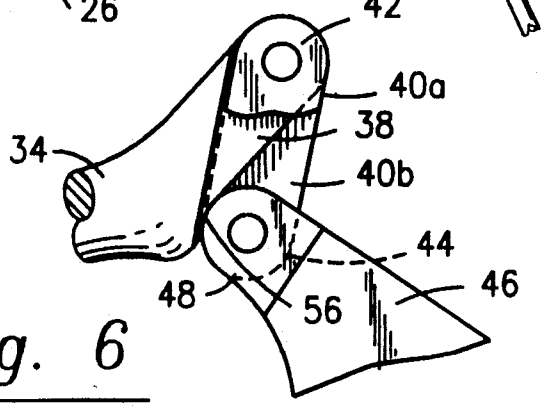
FIG. 6 shows a portion of the apparatus of FIG. 5 broken away to illustrate details of the detent.
Figure 8:
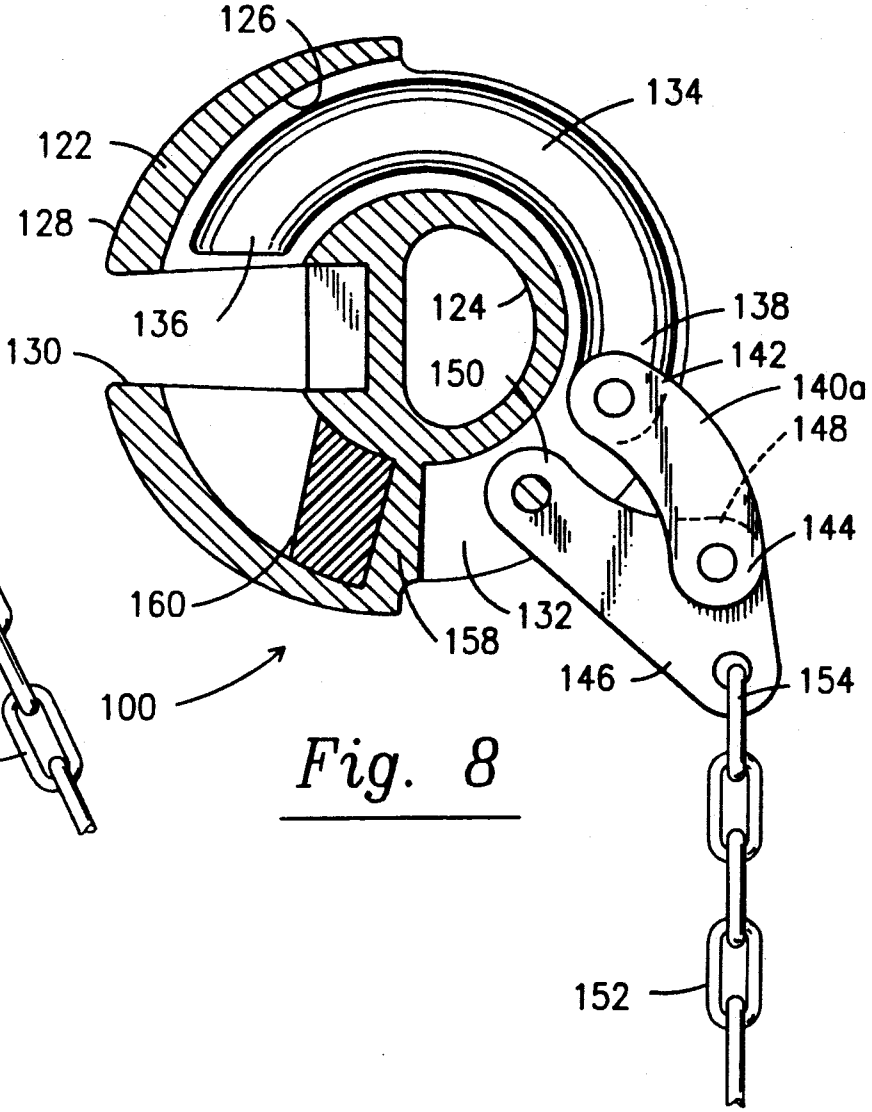
FIG. 8 shows the embodiment of FIG. 7 in partial section to illustrate the interior detail of the apparatus in the open position.
Figure 7:
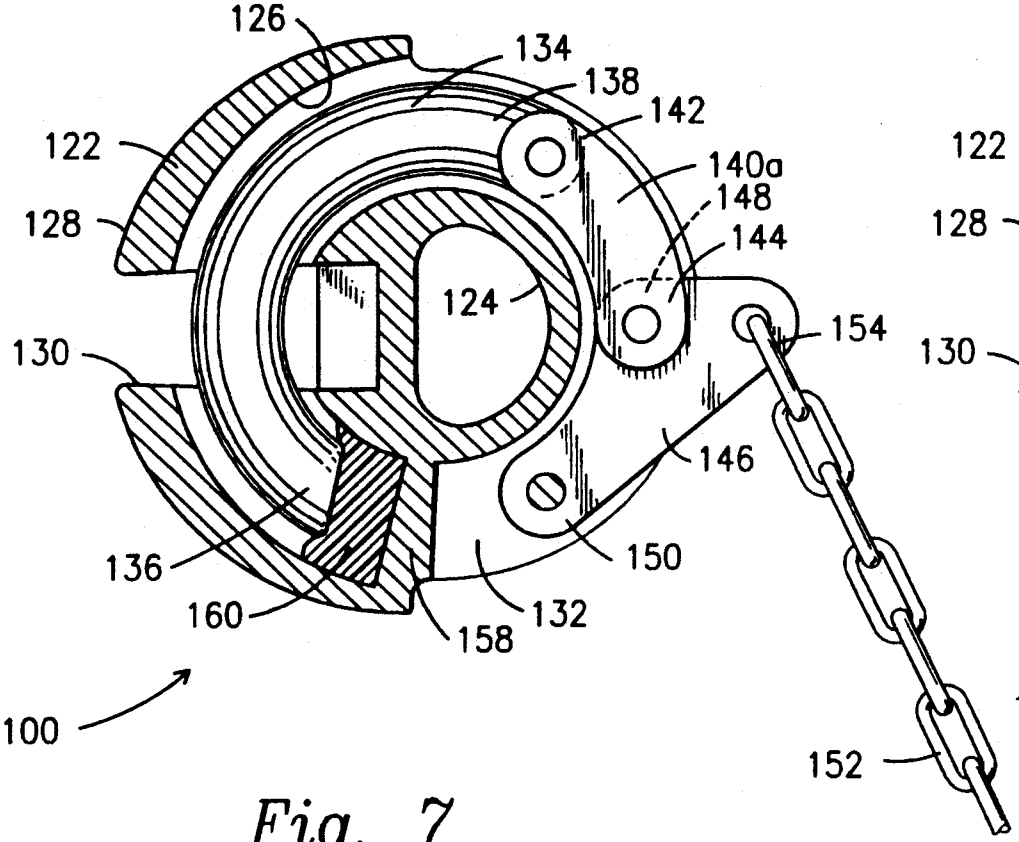
FIG. 7 shows a second embodiment of the invention in partial section to illustrate the interior detail of the apparatus in the closed position.

A preferred embodiment for the apparatus of this invention is illustrated in the drawing FIGS. 1–6 in which the apparatus is generally indicated as 10. FIGS. 7 and 8 illustrate a second embodiment of the invention in which the apparatus is indicated as 100 with similar parts utilizing reference numerals increased by increments of 100. In FIG. 1, the apparatus is illustrated attached to a shackle 12 and located proximal to a load, illustrated as a portion of a concrete slab 14. The slab 14 has a recess 16 formed therein and an anchor 18 embedded within the slab 14 so that a portion of the anchor 18 extends into the recess 16. This portion of the anchor 18 has a hole 20 therethrough.

Figure 4:
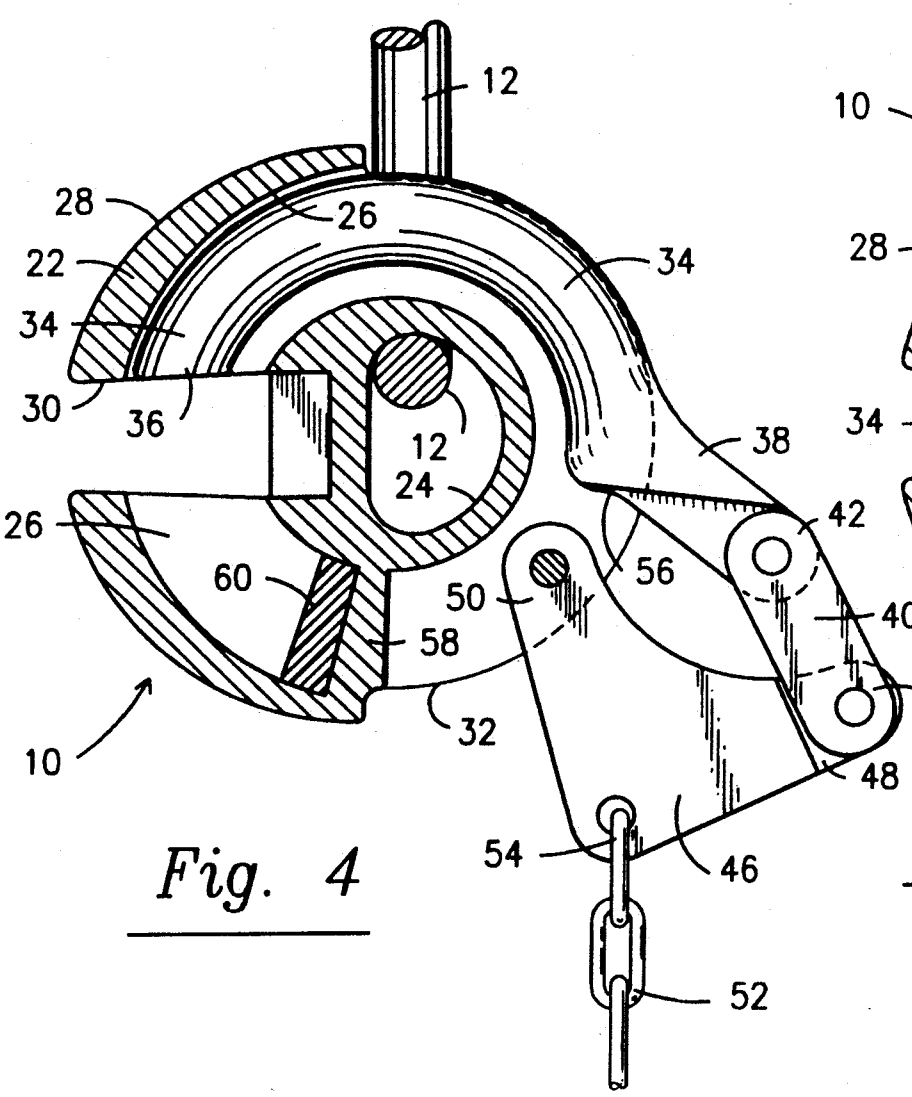
FIG. 4 shows the apparatus of FIG. 3 partially in section to illustrate the interior detail.

The apparatus 10 is comprised of a hollow annular body 22 that has a generally central aperture 24 formed therethrough. Within the body is a annular cavity 26 that extends about the central aperture 24. The maximum circumference of the body 22 defines a peripheral edge 28. A radial slot 30 extends inwardly from the peripheral edge 28 toward the aperture 24. As seen in FIG. 4 and 5, the slot 30 passes through the body 22 transverse to the cavity 26 and across the cavity 26. A segment of the peripheral edge 28 is removed to form an opening 32 into the cavity 26. This opening 32 through the peripheral edge 28 is generally opposed to the portion of the peripheral edge 28 through which the radial slot 30 extends.

Figure 3:
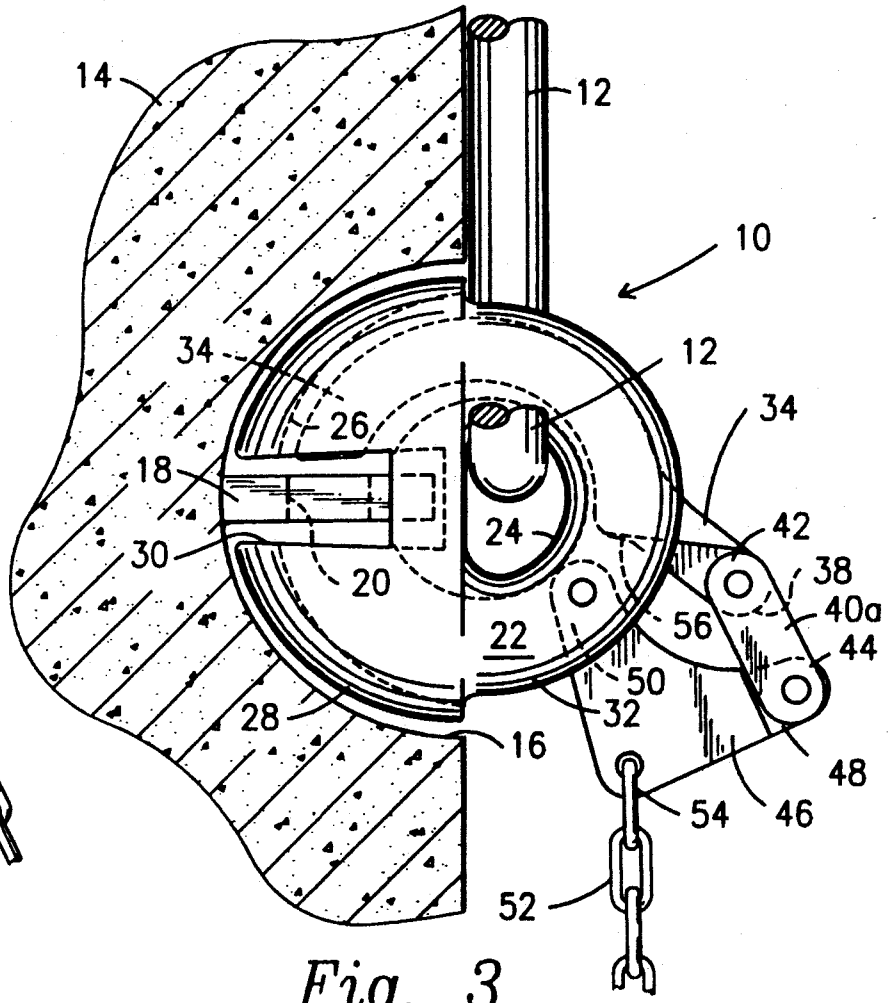
FIG. 3 is a front elevation of the apparatus of FIG. 2 illustrating the apparatus in the open position.
Figure 2:
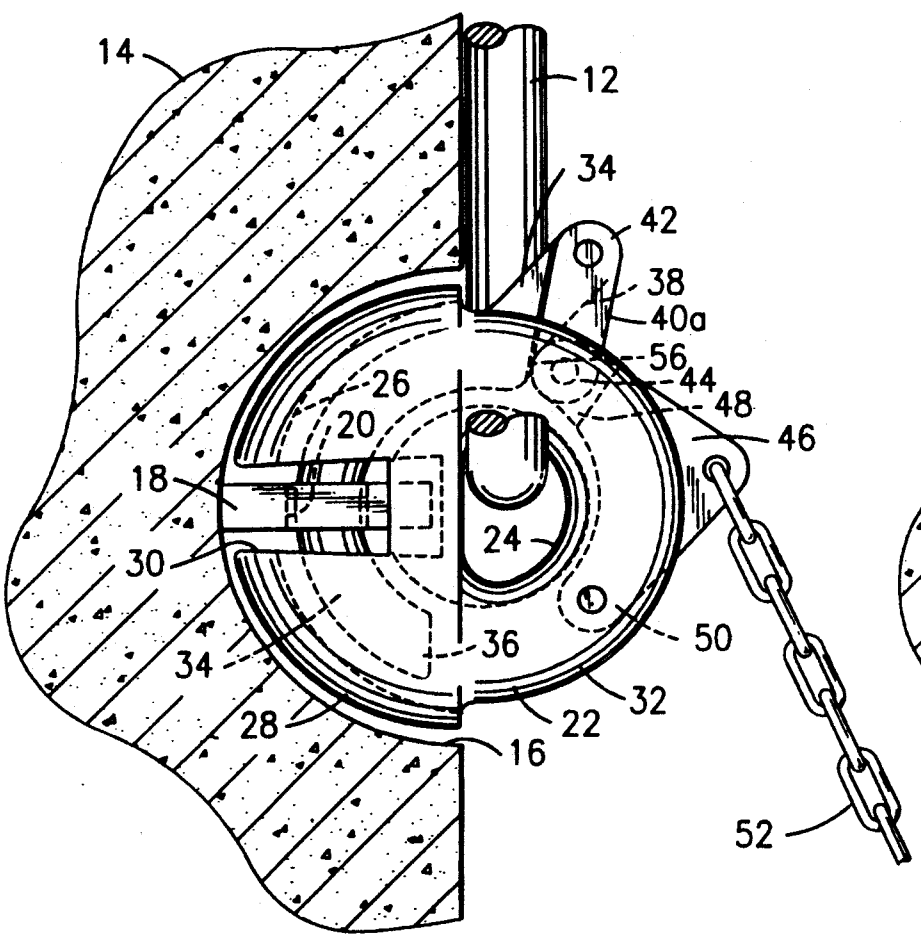
FIG. 2 is a front elevation of the invention of FIG. 1 illustrating the apparatus attached to a concrete slab held in an upright position.

An arcuate bolt 34 having a first end 36 and a second end 38 is received by the cavity 26. The bolt 34 is operatively movable within the cavity 26 from a closed position as seen in FIGS. 2 and 5, to an open position, as seen in FIGS. 1, 3 and 4. In the closed position, the first end 36 of the bolt 34 extends across the radial slot 30. In the preferred embodiment, the second end 38 of the bolt 34 extends through the opening 32 in the peripheral edge 28 and outwardly from the body 22. In the open position, the bolt 34 is substantially clear of the radial slot 30.

At least one connector link 40*a* is pivotally connected by its first end 42 to the second end 38 of the bolt 34. An actuating link 46 is pivotally connected by its first end 48 to the second end 44 of the connector link 40*a*. The second end 50 of the actuating link 46 is pivotally attached to the annular body 22. The pivotal connections, joining the bolt 34, connector link 40*a* and actuating link 46, may be formed by pins, rivets or other means well known in the art. In the preferred embodiment, as best seen in FIG. 6, two connector links 40*a*, which is broken away, and 40*b* are used to join the bolt 34 to the actuating link 46. The second end 38 of the bolt 34 has been reduced in thickness and is sandwiched between the first ends 42 of each link 40*a* and 40*b*. The first end 48 of the actuating link 46 has also been reduced in thickness and is sandwiched between the second ends 44 of the pair of connector links 40*a* and 40*b*. When the bolt 34 is in the closed position, a section of the actuating link 46 projects outwardly from the body 22 through the opening 32 in the peripheral edge 28. A release means, conveniently chain 52, is attached to this projecting section of the actuating link 46 so that the first end 48 of the actuating link 46 may be rotated outwardly from the body 22, pivoting about the second end 50 of the actuating link 46. The pivoting motion of the actuating link 46 results in movement of the bolt 34 within the annular cavity 26 from the closed position to the open position, illustrated in FIG. 4. A detent 56 is formed in the bolt 34 proximal to the second end 38 to capture the first end 48 of the actuating link 46 when the bolt 34 is in the closed position.

In the preferred embodiment, as shown in FIG. 5, the annular cavity 26 is discontinuous, having a blocking part 58 formed in the body 22 that extends substantially across the cavity 26 proximal to the first end 36 of the bolt 34, when the bolt 34 is in the closed position. When the bolt 34 is in the closed position, a biasing means 60 is interposed between the blocking part 58 and the first end 36 of the bolt 34, such that the bolt 34 is biased toward the open position. The biasing means 60 in the preferred embodiment is comprised of a resilient material. In other embodiments, the biasing means 60 may be comprised of springs or other similar well known devices. In still other embodiments, the cavity 26 may be continuous and the biasing means 60 may be attached to the body 22.

A second embodiment of the apparatus 10 is shown in FIGS. 7 and 8 and is identified by reference number 100. The configuration of the body 122 remains the same with the differences resting in the configuration of the second end 136 of the bolt 134, the connecting links (link 140*a* and the second link hidden by link 140*a*, having a relationship similar to the relationship between links 40*a* and 40*b* shown in FIG. 6) and the actuating link 146. In this embodiment, the first end 136 of the bolt 134 remains within the cavity 126 and no separately defined detent 156 is formed. The bolt 134 is held in the closed position by the rotational pressure applied by the biasing means 160. This pressure will maintain the relationship between the bolt 134, the curved connector links (link 140*a* and the second link hidden by link 140*a*) and the actuating link 146. An outward force must be applied to the actuating link 146 by the chain 152 to release the bolt 134 from its closed position. The open position of apparatus 100 is shown in FIG. 8.

Having thus set forth a preferred construction for the apparatus 10 of this invention, it is to be remembered that this is but a preferred embodiment. Attention is now invited to a description of the use of the apparatus 10.

The apparatus 10 may be used in conjunction with lifting all manner of loads; however, it is particularly suitable for lifting prefabricated tilt-up panels. Therefore, the description of use will be oriented toward movement of such a panel, conveniently a concrete slab 14. Tilt-up panels are normally fabricated in a horizontal position and have anchors 18 and recesses 16 formed into the concrete slab 14 during fabrication. The slab 14 may be formed on site or may be delivered to the site for erection. As shown in FIG. 1, the slab 14 is horizontally oriented with the apparatus 10 hanging from a shackle 12 directly above the anchor 18. A shackle 12, a cable, or a hook may be used for connecting the apparatus 10 to the lifting mechanism (not shown), typically a crane. The slab 14 is generally simultaneously lifted from a number of different points or anchors utilizing a harness having a plurality of apparatuses 10 attached thereto.

The apparatus 10 is placed in the open position as shown in FIG. 1, and is lowered so that the slot 30 is placed about the anchor 18 with the hole 20 through the anchor 18 being aligned with the cavity 26. The bolt 34 is moved within the cavity 26 so that it passes through the hole 20 of the anchor 18. The bolt 34 is moved about the cavity until it engages and compresses the biasing means 60. At this time, the connector links 40*a* and 40*b* and the actuating link 46 have assumed the closed and locked position shown in FIG. 5. The biasing means 60 urges the bolt 34 toward the open position, thus, applying pressure to the first end 48 of the actuating link 46 causing the first end 48 of the actuating link 46 to be captured by the detent 56. By being so captured, the bolt 34 is locked in the closed position.

After the slab has been tilted into an upright position, as illustrated in FIG. 2, the apparatus 10 is still positively attached to the slab 14. When the shackle 12 is no longer holding the load of the slab 14, the apparatus remains locked so that if the slab 14 should move while the lifting lines are slack, the slab will remain attached to the lifting means. This can be clearly seen in FIG. 2. By pulling on the chain 52, the actuating link 46 is released from the detent 56 and the bolt 34 is moved into the open position allowing easy removal of the apparatus 10 from the anchor 18 and, thus, from the slab 14.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention hereinafter described, and all statements of the scope of the invention which, as a matter of language, might be said to fall therebetween. Now that the invention has been described,

What is claimed is:

1. An apparatus for attaching a lifting means to a load to be lifted comprising:

an annular body having an outer peripheral edge about the maximum circumference of said body, said body having an annular cavity therein, a generally central aperture formed through said body, and a radial slot in said body extending generally transverse to said cavity from said outer peripheral edge to a point substantially across said annular cavity, and said body having an open segment in said peripheral edge, said open segment being generally opposed to said portion of said peripheral edge from which said radial slot extends;

an arcuate bolt having a first end and a second end, said bolt being received by said cavity of said body, said bolt being operatively movable within said cavity of said body, from a closed position wherein said first end of said bolt extends across said radial slot, to an open position wherein said bolt is clear of said radial slot, whereby a load may be attached to said apparatus by said bolt when said bolt is in said closed position;

at least one connector link having a first end and a second end, said first end being pivotally attached to said second end of said bolt;

an actuating link having a first end and a second end, said first end of said actuating link being pivotally attached to said second end of said connector link, said second end of said actuating link being pivotally attached to said annular body, and said actuating link having a section that extends outwardly through said open segment in said peripheral edge; and a release means directly attached to said actuating link such that said first end of said actuating link may be moved outwardly in relation to said body, pivoting about said second end of said actuating link, whereby said bolt moves within said body to said open position.

2. An apparatus as in claim 1 wherein said second end of said bolt extends outwardly from and through said open segment in said peripheral edge of said annular body, said apparatus further comprising a detent located proximal to said second end of said bolt such that when said bolt is in said closed position said first end of said actuating link engages said detent.

3. An apparatus as in claim 1 further comprising a biasing means fixed within said cavity to contact said first end of said bolt when said bolt is in said closed position, such that said bolt in said closed position is biased toward said open position.

4. An apparatus as in claim 1 wherein said annular cavity is discontinuous, said discontinuity being proximal said first end of said bolt when said bolt is in said closed position, said annular body further comprising a biasing means interposed between said first end of said bolt and said discontinuity such that said bolt in said closed position contacts said biasing means, whereby said bolt is biased toward said open position.

5. An apparatus as in claim 4 wherein said biasing means comprises a resilient material.

* * * * *